US005284322A

United States Patent [19]

Clark

[11] Patent Number: 5,284,322

[45] Date of Patent: Feb. 8, 1994

[54] STAPLE PULLER WITH MEANS FOR GRIPPING A STAPLE

[76] Inventor: Conrad J. Clark, 7058 Idylwood Rd., Falls Church, Va. 22043

[21] Appl. No.: 986,685

[22] Filed: Dec. 8, 1992

[51] Int. Cl.[5] ..... B25C 11/00

[52] U.S. Cl. ..... 254/28

[58] Field of Search ..... 254/28, 18; 7/125, 166

[56] References Cited

U.S. PATENT DOCUMENTS

| | | | |
|---|---|---|---|
| 499,637 | 6/1893 | Knight . | |
| 858,257 | 6/1907 | Breiding . | |
| 3,311,346 | 3/1967 | Almond, Jr. . | |
| 2,431,922 | 2/1974 | Curtiss . | |
| 2,549,260 | 4/1951 | Sidbury | 254/28 |
| 2,553,660 | 5/1951 | Levendusky | 254/28 |
| 4,869,464 | 9/1989 | Davidson . | |
| 4,921,216 | 5/1990 | Krulich | 254/28 |
| 4,944,491 | 7/1990 | Kirk . | |
| 5,085,404 | 2/1992 | Thieleke et al. | 254/28 |
| 5,090,662 | 2/1992 | Koo | 254/28 |

*Primary Examiner*—Robert C. Watson

[57] ABSTRACT

A staple puller of the type having cam surfaces for pulling a staple from an object has gripping surfaces at the upper ends of the cam surfaces to allow the staple being pulled to be securely gripped after the pulling action of the cam surfaces has ceased. A release slot is provided adjacent the gripping surfaces to receive a previously pulled staple such that it does not interfere with the pulling or gripping of a staple being pulled.

10 Claims, 1 Drawing Sheet

FIG. 1
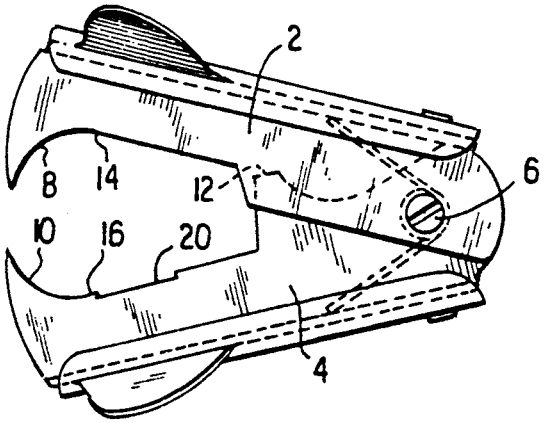
FIG. 2
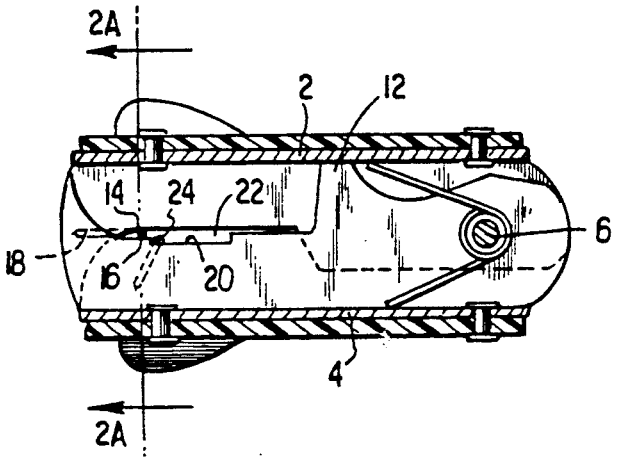
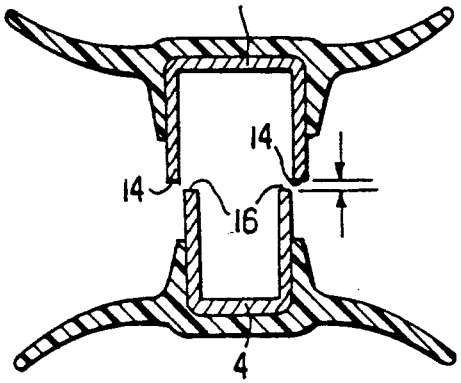
FIG. 2A
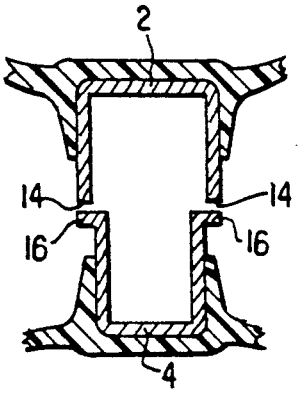
FIG. 2B

STAPLE PULLER WITH MEANS FOR GRIPPING A STAPLE

TECHNICAL FIELD

This invention relates to the art of staple pullers, and particularly to the art of hand-held staple pullers of the type having coacting cam surfaces that engage and remove a staple.

BACKGROUND ART

A well known staple remover comprises two pivotally attached parts that have cam surfaces at their respective ends. The device is held in the hand of a user, and the two parts are squeezed together by the user after the tips of the cams have been engaged with the staple. The bight of the staple is moved along the cam surfaces as the parts move toward each other to lift the staple and remove it from an object.

A common problem with this type of staple remover is that the staple is pulled from the object in an uneven manner, which typically results in one leg remaining lodged in the object while the other leg is free. Another, similar problem is that the staple is often broken by the action of the puller, leaving the part remaining in the object separate from the remainder of the staple. The flat parts of the known staple remover adjacent the cam surface do not permit secure gripping of the staple as this would interfere with the removal of subsequent staples.

Various arrangements have been proposed to allow the part of the staple that remains in the object to be grasped by the staple puller in a manner that does not rely on the action of the cam surfaces. One such arrangement is shown in U.S. Pat. No. 3,311,346 (Almond, Jr.). The staple remover according to this patent includes a block mounted in each of the channel-like parts of the staple remover such that the staple can be grasped between the blocks and pulled out. U.S. Pat. No. 4,921,216 (Krulich) shows a staple remover of the same general type wherein one of the cam surfaces has a notch for receiving the staple and for holding the staple securely by a force applied by the cam surface of the other part.

Arrangements similar to that of Krulich are shown by U.S. Pat. Nos. 858,257 (Breiding), 2,431,922 (Curtiss), and 4,869,464 (Davidson).

U.S. Pat. No. 4,944,491 (Kirk) teaches a staple puller wherein the cam surfaces are flanked by protrusions that expand the legs of the staple. U.S. Pat. No. 499,637 (Knight) shows yet another type of staple extractor.

The prior art staple pullers having gripping parts do not provide effective means for releasing or ejecting a staple from the gripping parts. It is difficult, therefore, in this type of device to remove a plurality of staples in succession without manually clearing each pulled staple from the device. Moreover, the devices having gripping elements are not easily manufactured, requiring assembly of several parts or complicated stamping of the parts.

SUMMARY OF THE INVENTION

In accordance with the invention, a staple puller of the type having two pivotally mounted parts and cam surfaces at the ends of each of the parts is provided with gripping means at the upper ends of the cam surfaces and releasing means whereby the staple may easily be ejected from the gripping means by the next staple pulled. This allows the user to remove a number of staples in succession without having to stop to clear the device of each pulled staple.

In the preferred embodiment, the staple puller of the invention includes two channel-like parts. The cam surfaces are located at respective ends of these parts, and the gripping element is formed by flat portions of the upper edges of the two parts just at the upper ends of the cam surfaces. It is within the contemplation of the invention, however, that the gripping elements be parts of the cam surfaces, and the gripping surfaces may be curved. If the gripping surfaces are curved, the curvature should be such that gripping of the staple is facilitated.

The releasing means in the preferred embodiment is a notch adjacent the gripping means for allowing free movement of removed staples along the channel and to obviate the necessity for frequent clearing of the pulled staples.

BRIEF DESCRIPTION OF THE DRAWINGS

FIG. 1 is a side view of a staple remover according to the invention in an open position.

FIG. 2 is a longitudinal cross section of the staple remover of FIG. 1 in a closed position with two removed staples therein.

FIG. 2A is a cross section taken along line 2A—2A of FIG. 1.

FIG. 2B is a transverse cross section of a second embodiment of the invention.

DETAILED DESCRIPTION OF THE PREFERRED EMBODIMENT

With reference to the drawings, a preferred embodiment of a staple remover according to the invention comprises a first part 2 pivotally attached to a second part 4 at a pin 6. These parts are channel-shaped in transverse cross section, and part 4 is slightly narrower than part 2 to allow it to fit between the sides of part 2. Part 2 includes a cam surface 8 at one end, and part 4 includes a cam surface 10 at an adjacent end. Cam surfaces 8 and 10 terminate in sharp tips to allow the cam surfaces to be forced under the bight of a staple and to pull the staple from an object in a manner known in the art.

A stop 12 is carried by part 4, the stop engaging the bottom of part 2 when the parts are in the fully closed position. In known staple removers, the staple is pulled from the object only by the action of the cam surfaces, and the stop 12 is positioned to prevent significant clamping of the staple between the first and second parts. In accordance with the invention, however, the part 2 is provided with gripping surface 14, part 4 is provided with gripping surface 16, and stop 12 is positioned to allow the gripping surfaces to engage securely the bight of a staple.

The gripping surfaces 1 4 and 16 are preferably located at respective ends of the cam surfaces 8 and 10 such that the staple is pushed onto the gripping surfaces just as the pulling action provided by the cam surfaces ceases. This is illustrated in FIG. 2 where a staple 18 is shown with its bight portion engaged by the gripping elements 14 and 16. The stop 12 is positioned to allow the gripping surfaces to securely grasp the bight of the staple while preventing engagement that would cut the staple. This gripping of the staple allows the user to pull the staple out of the object, for example, in those instances when the staple has been pulled unevenly from the object, and one leg is free of the object while the other remains lodged in it.

The length of each of the gripping surfaces is preferably approximately equal to the thickness of the bight of the staple. By this construction, only one staple at a time is engaged by the gripping surfaces, and a previously pulled staple will not interfere with the pulling of a subsequent staple. In the preferred embodiment shown, a notch 20 is cut into the part 4 behind the gripping surfaces to provide a release slot 22 between the notch and the upper edge of the channel of part 2. The release slot receives the staples, such as that illustrated at 24, which have previously been removed. The previously pulled staples will not be clamped between the first and second parts and will generally be freely pushed along the release slot by subsequently pulled staples.

The cam surfaces and the gripping surfaces are arranged such that a staple that has just been pulled will be pushed out of engagement with the gripping surfaces by a staple that is moving along the cam surfaces. The staple moving along the cam surfaces will push a staple in the region of the gripping surfaces into the release slot, thus allowing the staple being pulled to be engaged by the gripping surfaces.

Gripping surface 14 preferably comprises two flattened areas on the upper edges of the channel that forms part 2, and gripping surface 16 preferably comprises similar structure on the edges of the channel that forms part 4. This is shown by FIG. 2A. It should be noted that because the channel that forms part 4 is narrower than the channel that forms part 2, the two sets of gripping surfaces will be displaced from each other in a transverse direction. While this arrangement provides secure gripping of the staple 18 it may, nevertheless, be desirable to provide an outward projection from the sides of the channel that forms part 4 just at the upper end of the cam surface so that the gripping surfaces 14 are not displaced from the gripping surfaces 16. This structure is shown in FIG. 2B. The former structure has the advantage that manufacture is more simple. In addition, the gripping surfaces may be provided with serrations or other structure that increases the gripping strength.

It will be appreciated that a unique staple remover has been shown and described. Modifications within the scope of the appended claims will be apparent to those of skill in the art.

I claim:

1. In a staple puller having first and second parts mounted for movement with respect to each other, each of said parts having a cam surface at a respective end thereof for coacting with the cam surface of the other of said parts for engaging and pulling said staple from an object as said first and second parts move toward each other, the improvement comprising gripping means contiguous with upper portions of said cam surfaces for receiving a staple moved into contact therewith by said cam surfaces and for gripping said staple tightly and releasing means contiguous with said gripping means for releasing said staple from said gripping means upon movement of a subsequent staple into engagement with said gripping means.

2. A staple puller according to claim 1 wherein each of said first and second parts is channel-shaped, and said gripping means comprises upper edges on sides of said first and second parts.

3. A staple puller according to claim 2 wherein said releasing means comprises a cutout in the sides of at least one of said parts.

4. A staple puller according to claim 3 wherein said releasing means further comprises said cam surfaces whereby a said subsequent staple is urged by said cam surfaces to push said staple out of engagement with said upper edges.

5. A staple puller according to claim 3 wherein the length of said upper edges is substantially that of the thickness of a staple.

6. A staple puller according to claim 5 wherein said upper edges are substantially flat.

7. A staple puller according to claim 6 wherein said upper edges include means for increasing the gripping ability of said gripping means.

8. A staple puller according to claim 7 wherein said first and second parts are pivotally connected to each other.

9. A staple puller comprising a first part comprising a channel having opposed sides and a first cam surface at one end thereof for engaging a staple to be pulled, and a second part comprising a channel having opposed sides and a second cam surface at one end thereof for engaging said staple to be pulled, wherein said first and second parts are pivotally connected to each other and the width of said first part is less than that of said second part such that said opposed sides of said first part fit between said opposed sides of said second part and said sides of said first and second parts further comprise gripping means for securely gripping said staple being pulled therebetween, said gripping means lying at uppermost portions of said cam surfaces and being smoothly connected to said cam surfaces such that said staple is moved into contact with said gripping means by the action of said cam surfaces, and further comprising release means contiguous with said gripping means for releasing the bight of a staple that has been pulled out of an object from engagement with said first or second parts.

10. A staple puller according to claim 9 wherein said gripping means for said first part comprises a portion of said sides of said channel of said first part that has a width substantially that of the channel of said second part.

* * * * *